US009541096B2

(12) United States Patent
Tsai

(10) Patent No.: US 9,541,096 B2
(45) **Date of Patent: *Jan. 10, 2017**

(54) AIR PUMP CAPABLE OF AUTOMATIC AIR SUPPLEMENTS

(71) Applicant: Dongguan Tiger Point, Metal & Plastic Products Co., Ltd., Dongguan, Guang Dong Province (CN)

(72) Inventor: Chun-Chung Tsai, Dongguan (CN)

(73) Assignee: Dongguan Tiger Point, Metal & Plastic Products Co. Ltd., Dongguan (CN)

( * ) Notice: Subject to any disclaimer, the term of this patent is extended or adjusted under 35 U.S.C. 154(b) by 280 days.

This patent is subject to a terminal disclaimer.

(21) Appl. No.: 14/152,134

(22) Filed: Jan. 10, 2014

(65) Prior Publication Data

US 2015/0198168 A1 Jul. 16, 2015

(51) Int. Cl.

| | |
|---|---|
| ***F04D 29/54*** | (2006.01) |
| ***F04D 25/08*** | (2006.01) |
| ***F04D 29/42*** | (2006.01) |
| ***F04D 29/44*** | (2006.01) |

(52) U.S. Cl.

CPC ..... *F04D 29/541* (2013.01); *F04D 25/084* (2013.01); *F04D 29/4226* (2013.01); *F04D 29/441* (2013.01)

(58) Field of Classification Search

None

See application file for complete search history.

(56) References Cited

U.S. PATENT DOCUMENTS

| | | | | |
|---|---|---|---|---|
| 4,558,992 | A * | 12/1985 | Hamano | F04D 27/005 417/250 |
| 7,475,443 | B2 * | 1/2009 | Wang | H01H 35/245 200/82 R |
| 2010/0247355 | A1 * | 9/2010 | Pan | F04D 29/602 417/423.14 |

* cited by examiner

*Primary Examiner* — Charles Freay
*Assistant Examiner* — Thomas Cash
(74) *Attorney, Agent, or Firm* — Alan D. Kamrath; Kamrath IP Lawfirm, P.A.

(57) ABSTRACT

An air pump capable of automatic air supplements has a housing, a low-pressure blower, a high-pressure blower, a first auto-stop controller, and a second auto-stop controller. The low-pressure blower is used to inflate an inflatable article with low-pressure air and allows the air pump to stop working during inflation automatically. The high-pressure blower is used to inflate an inflatable article with adjustable high pressure air, so that the inflatable article can have a hardness suitable for a user's need, and allows the air pump to stop working automatically during inflation or to supply air automatically during inflation. The air pump can stop working automatically and can supply air automatically without manual work, and can inflate the inflatable article to the hardness suitable for the user's need conveniently.

9 Claims, 20 Drawing Sheets

AIR PUMP CAPABLE OF AUTOMATIC AIR SUPPLEMENTS

BACKGROUND OF THE INVENTION

1. Field of the Invention

The present invention relates to an air pump and, especially, to an air pump that supplies air automatically.

2. Description of the Prior Art(s)

Air pumps are critical to all kinds of inflatable articles, such as airbeds, inflatable bouncers, inflatable sofas, inflatable toys, and the like. The air pump is mounted on an inner surface of the inflatable article, inflates the inflatable article and holds air inside the inflatable article at a constant pressure for use, and deflates the inflatable article for storage. Currently, some conventional air pumps can inflate and deflate the inflatable articles, and hold the air inside the inflatable articles at a constant pressure. Meanwhile, other conventional air pumps further have auto-stop controllers that stop the air pumps automatically. The auto-stop controller is mounted in a housing of the conventional air pump, and has a sensing film, a micro switch, a driving rod, a button, and a compression spring. The button is operated in a single stage, so that when the button is pressed, the driving rod is driven to move upwardly to push the sensing film. Accordingly, the sensing film deforms upward to switch the micro switch on. When the button is released, the compression spring pushes the driving rod to move downwardly. Accordingly, the sensing film deforms downward to switch the micro switch off. The micro switch controls an operation of the conventional air pump. Moreover, the conventional air pump may further have a main switch. The main switch independently controls the conventional air pump. To operate the conventional air pump, the main switch must be first switched on.

The auto-stop controller allows the conventional air pump to stop working automatically, which is a great convenience to users. However, performance of the conventional air pump is still inadequate to achieve a best usage effect and a best working performance. The shortcomings of the conventional air pump are described as follows. The conventional air pump only stops working automatically, but does not supply air to the inflatable article automatically. Thus, when the inflatable article is deflated, the micro switch should be manually switched on in order to supply the air to the inflatable article. Furthermore, since the conventional air pump can only inflate the inflatable article to a specific hardness, the hardness of the inflatable article cannot be adjusted according to the user's need. Thus, the conventional air pump is inconvenient for use and operation.

To overcome the shortcomings, the present invention provides an air pump capable of automatic air supplement to mitigate or obviate the aforementioned problems.

SUMMARY OF THE INVENTION

The main objective of the present invention is to provide an air pump capable of automatic air supplements. The air pump has a housing, and a low-pressure blower, a high-pressure blower, a first auto-stop controller, and a second auto-stop controller mounted in the housing. The low-pressure blower is used to inflate an inflatable article with low-pressure air and allows the air pump to stop working during inflation automatically. The high-pressure blower is used to inflate an inflatable article with adjustable high-pressure air so that the inflatable article can have hardness suitable for a user's need. The air pump is allowed to stop working automatically during inflation or to supply air automatically during inflation. The air pump can stop working automatically and can supply air automatically without manual work, and can inflate the inflatable article to the hardness suitable for the user's need conveniently.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
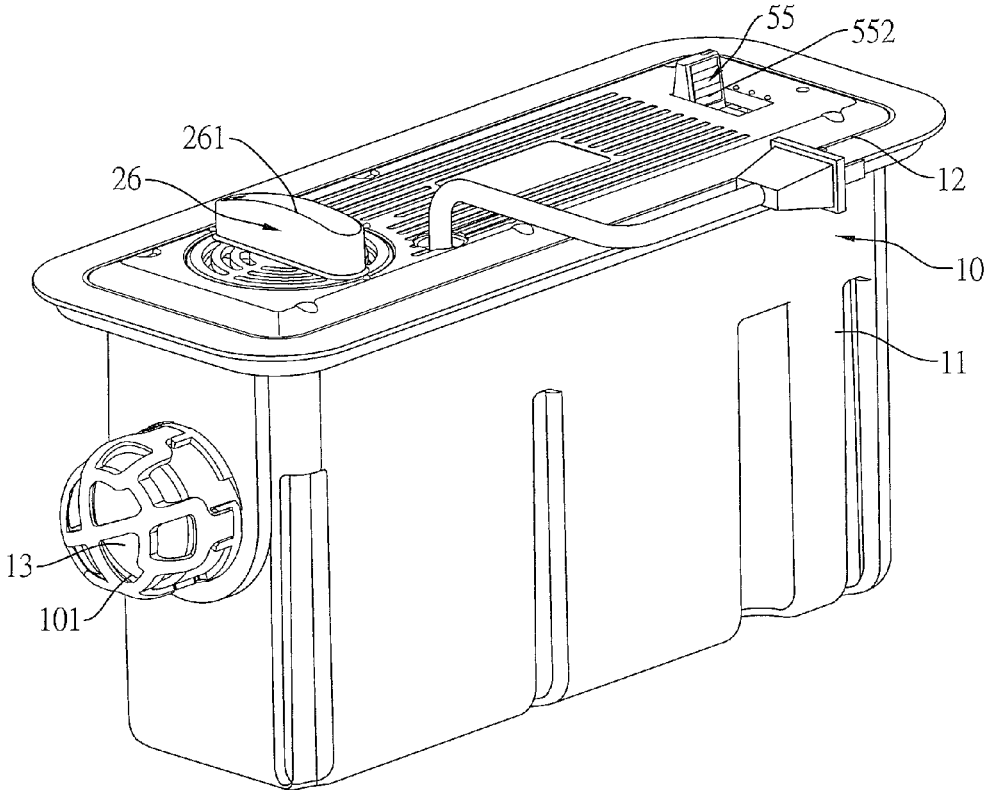
FIG. 1 is a front perspective view of an air pump capable of automatic air supplements in accordance with the present invention.

With reference to FIGS. 1 to 4, an air pump capable of automatic air supplements in accordance with the present invention comprises a housing 10, and a low-pressure blower 20, a high-pressure blower 30, a first auto-stop controller 40, and a second auto-stop controller 50 mounted in the housing 10.

The housing 10 has a base 11, a cover 12, and a mounting chamber. The cover 12 is mounted on the base 11 and has multiple slots. The mounting chamber is defined in the housing 10, is surrounded by the base 11 and the cover 12, and communicates with an exterior of the housing 10 via the slots of the cover 12. The mounting chamber is used for receiving the low-pressure blower 20, the high-pressure blower 30, the first auto-stop controller 40, and the second auto-stop controller 50.

Figure 5:
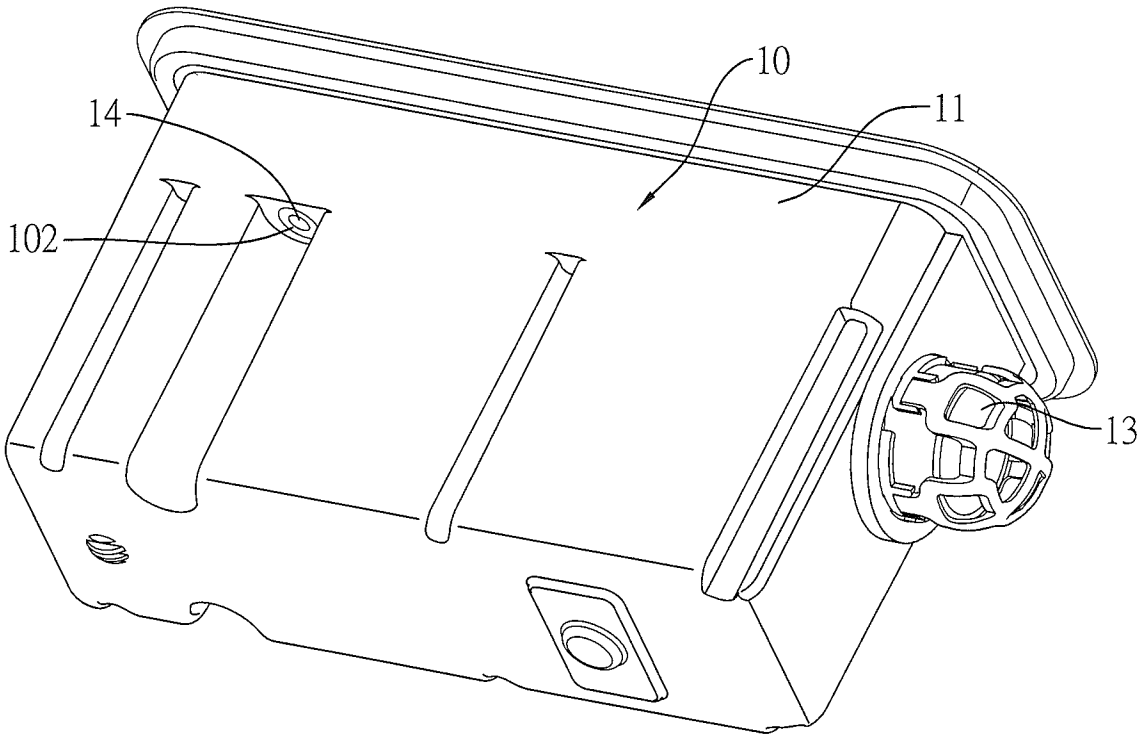
FIG. 5 is a rear lower perspective view of the air pump in FIG. 1.
Figure 6:
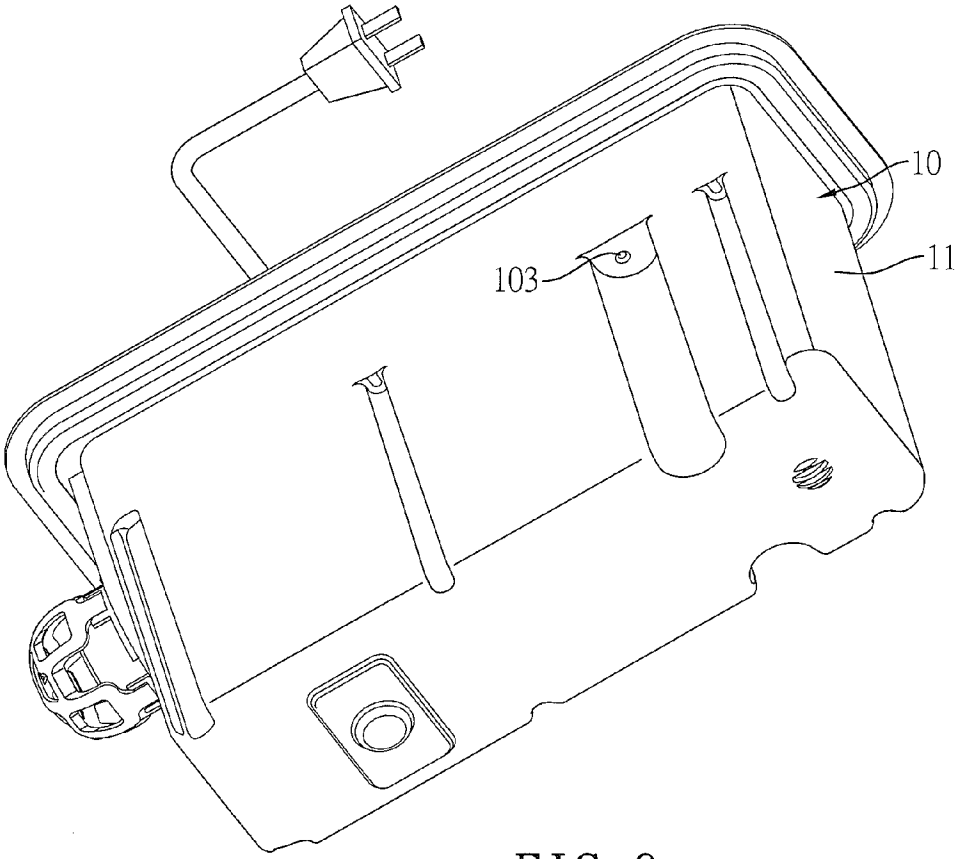
FIG. 6 is a front lower perspective view of the air pump in FIG. 1.

With reference to FIGS. 1, 5, and 6, the housing 10 further has a first air port 101, a second air port 102, a third air port 103, a first one-way valve 13 and a second one-way valve 14. The first air port 101 is used for communicating with an interior of an inflatable article. The first one-way valve 13 is mounted to the first air port 101. The second one-way valve 14 is mounted to the second air port 102.

Figure 9:
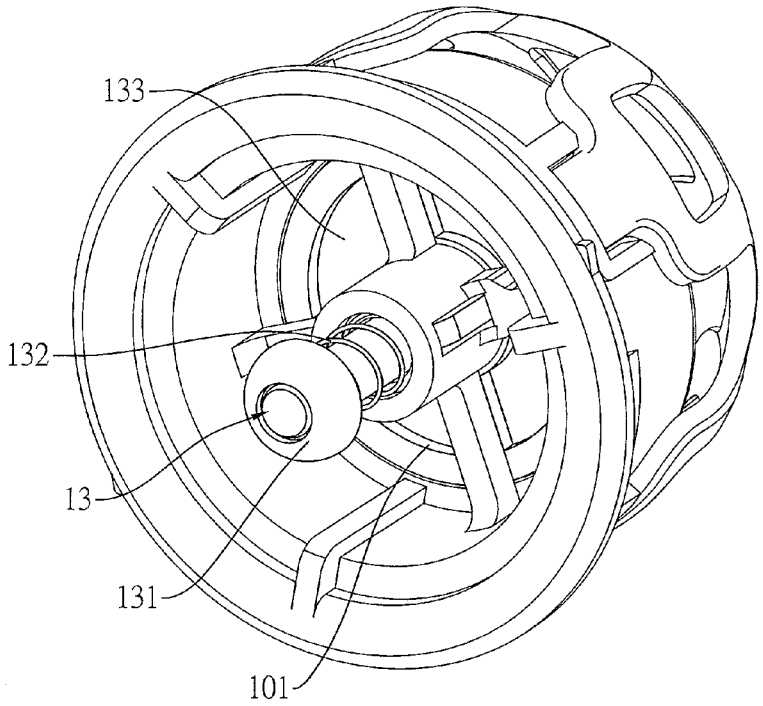
FIG. 9 is a perspective view of a first one-way valve of the air pump in FIG. 1, shown closed.
Figure 10:
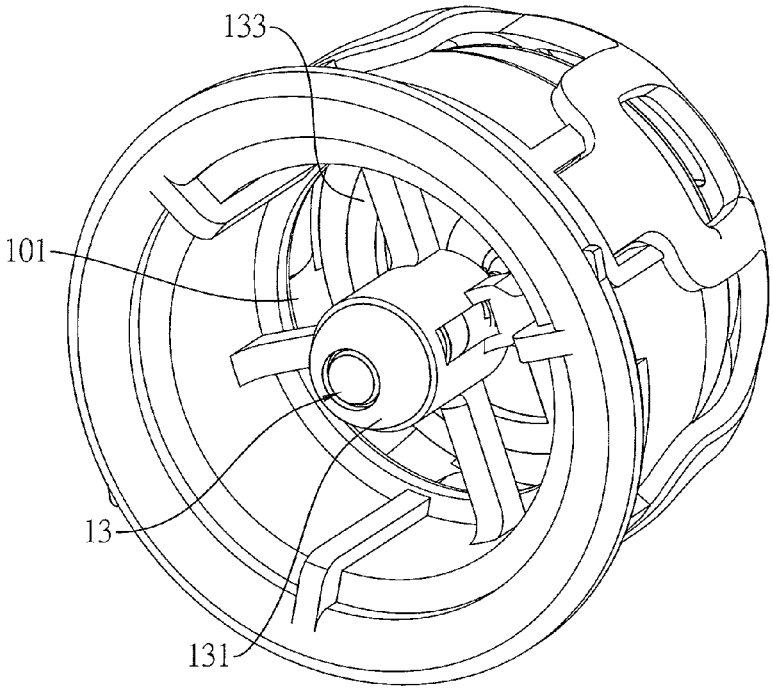
FIG. 10 is an operational perspective view of the first one-way valve in FIG. 9, shown open.

With further reference to FIGS. 9 and 10, the first one-way valve 13 has a driving rod 131, a valve blade 133, and a spring 132. The driving rod 131 has an outer end and an inner end. The outer end of the driving rod 131 protrudes toward the exterior of the housing 10. The inner end of the driving rod 131 protrudes toward the mounting chamber of the housing 10. The valve blade 133 is mounted on the outer end of the driving rod 131 and selectively seals the first air port 101 of the housing 10. The spring 132 is mounted around the driving rod 131 and has two opposite ends respectively abutting the housing 10 and the inner end of the driving rod 131. Thus, the spring 132 pushes the driving rod 131 to move toward the mounting chamber of the housing 10. Accordingly the valve blade 133 seals the first air port 101 of the housing 10. The second one-way valve 14 has the same structure as the first one-way valve 13, and description about the second one-way valve 14 is omitted.

Figure 2:
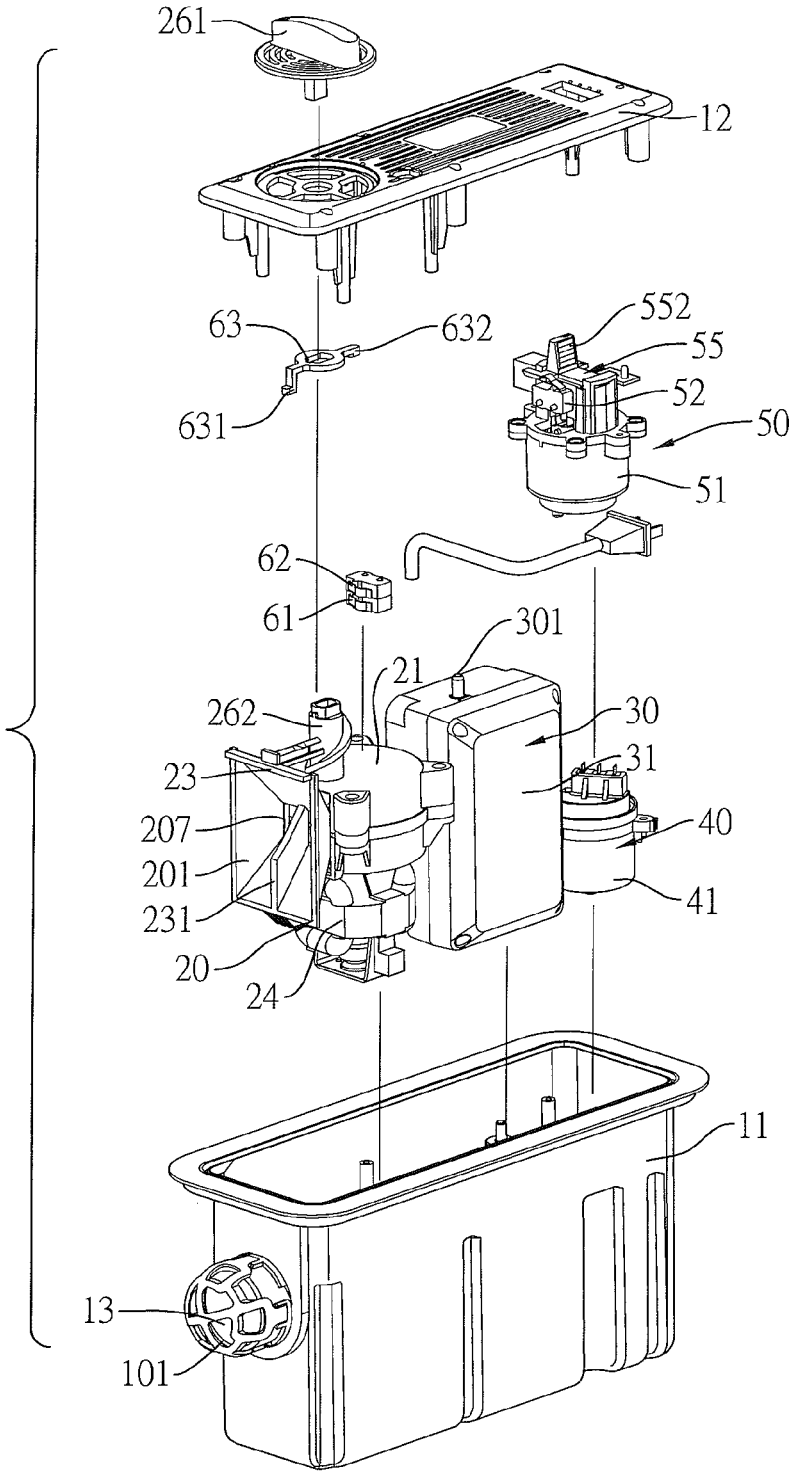
FIG. 2 is an exploded perspective view of the air pump in FIG. 1.

As shown in FIG. 2, the low-pressure blower 20 is mounted in the mounting chamber of the housing 10 and has a fourth air port 201. The fourth air port 201 communicates with the first air port 101 of the housing 10.

As shown in FIGS. 2 and 5, the high-pressure blower 30 is mounted in the mounting chamber of the housing 10 and has a fifth air port 301. The fifth air port 301 communicates with the second air port 102 of the housing 10.

With reference to FIGS. 3 and 12 to 15, the first auto-stop controller 40 is mounted in the mounting chamber of the housing 10 and has a first casing 41, a first micro switch 42, a first sensing film 43, and a first enclosed chamber 401. The first casing 41 has an inner surface. The first micro switch 42 is mounted on the first casing 41, is electrically connected to the low-pressure blower 20, and switches the low-pressure blower 20 on or off. The first sensing film 43 is mounted in the first casing 41, selectively triggers the first micro switch 42, and has an inner surface and an outer surface. The outer surface of the first sensing film 43 faces and is separated from the first micro switch 42. The first enclosed chamber 401 is surrounded by the inner surface of the first sensing film 43 and the inner surface of the first casing 41, and communicates with the third air port 103 of the housing 10.

With reference to FIGS. 2 and 16 to 20, the second auto-stop controller 50 is mounted in the mounting chamber of the housing 10 and has a second casing 51, a switching switch 52, a second micro switch 53, a second sensing film 54, a second enclosed chamber 501, and a first control mechanism 55. The second casing 51 has an inner surface. The switching switch 52 is electrically connected to the high-pressure blower 30 and selectively switches the high-pressure blower 30 on or off. The second micro switch 53 is mounted on the second casing 51, is electrically connected to the high-pressure blower 30, and switches the high-pressure blower 30 on or off. The second sensing film 54 is mounted in the second casing 51, selectively triggers the second micro switch 53, and has an inner surface and an outer surface. The outer surface of the second sensing film 54 faces and is separated from the second micro switch 53. The second enclosed chamber 501 is surrounded by the inner surface of the second sensing film 54 and the inner surface of the second casing 51, and communicates with the third air port 103 of the housing 10. The first control mechanism 55 selectively triggers the switching switch 52, and drives the second micro switch 53 to move toward or away from the second sensing film 54.

With reference to FIGS. 1 to 3, 7, and 8, specifically, in the preferred embodiment, the low-pressure blower 20 further has a third casing 21, a dividing panel 25, an impeller 22, a switching casing 23, a motor 24, and a second control mechanism 26. The third casing 21 has an inlet port 205 and an outlet port 206. The dividing panel 25 is mounted in the third casing 21 and divides an interior of the third casing 21 into an inlet chamber 202 and an outlet chamber 203. The inlet chamber 202 communicates with the inlet port 205. The outlet chamber 203 communicates with the outlet port 206. The dividing panel 25 has a through hole 204. The impeller 22 is mounted in the outlet chamber 203 and has an air-inlet portion and an air-outlet portion. The air-inlet portion of the impeller 22 corresponds in position to the through hole 204 of the dividing panel 25. The air-outlet portion of the impeller 22 corresponds in position to the outlet port 206 of the third casing 21. The switching casing 23 is mounted between the first air port 101 of the housing 10 and the third casing 21 and has an air channel 207. The air channel 207 communicates with the inlet port 205 of the third casing 21 or the outlet port 206 of the third casing 21. The motor 24 drives the impeller 22 to rotate. The second control mechanism 26 selectively drives the switching casing 23 to move to allow the air channel 207 to communicate with the inlet port 205 or the outlet port 206.

Figure 3:
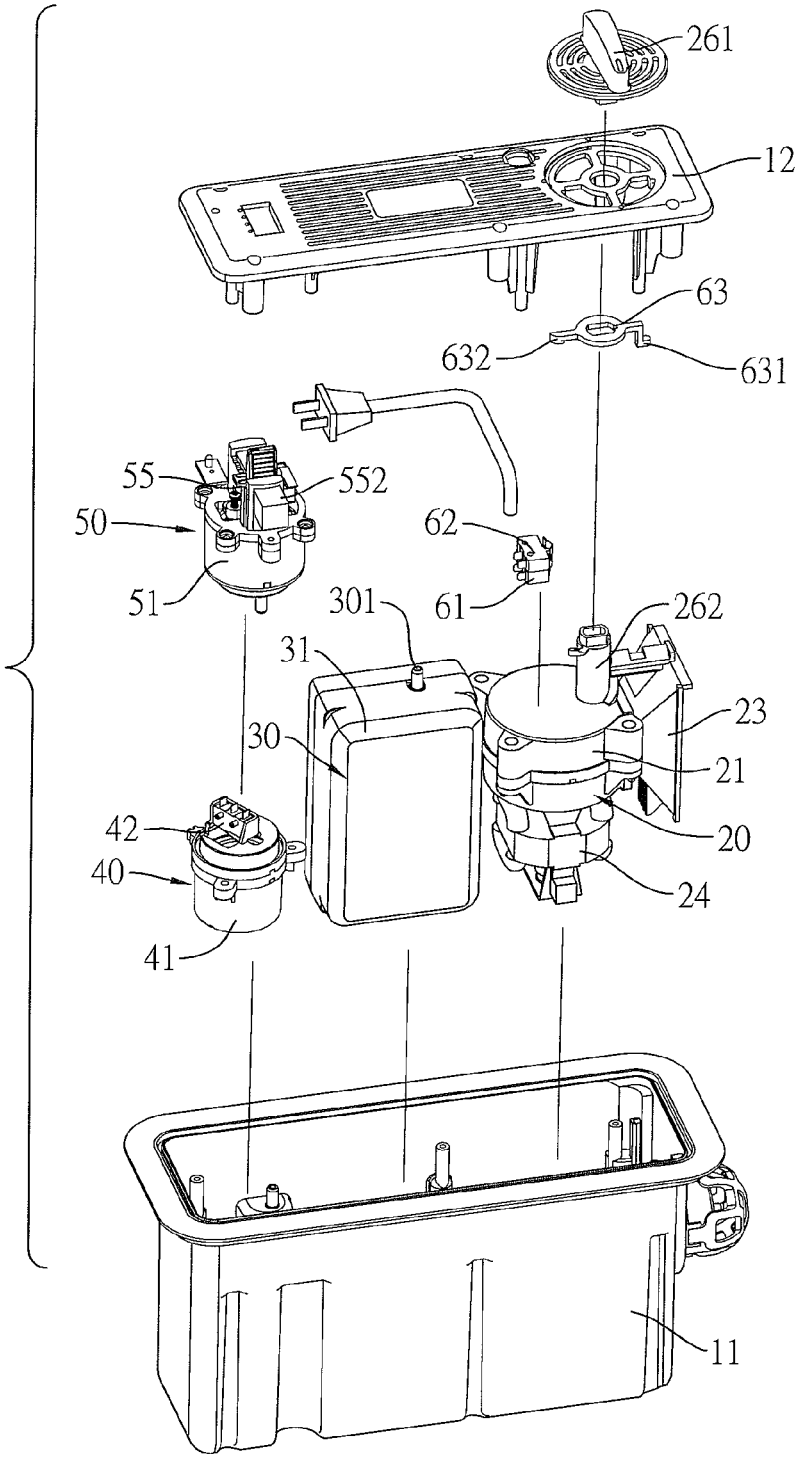
FIG. 3 is another exploded perspective view of the air pump in FIG. 1.
Figure 4:
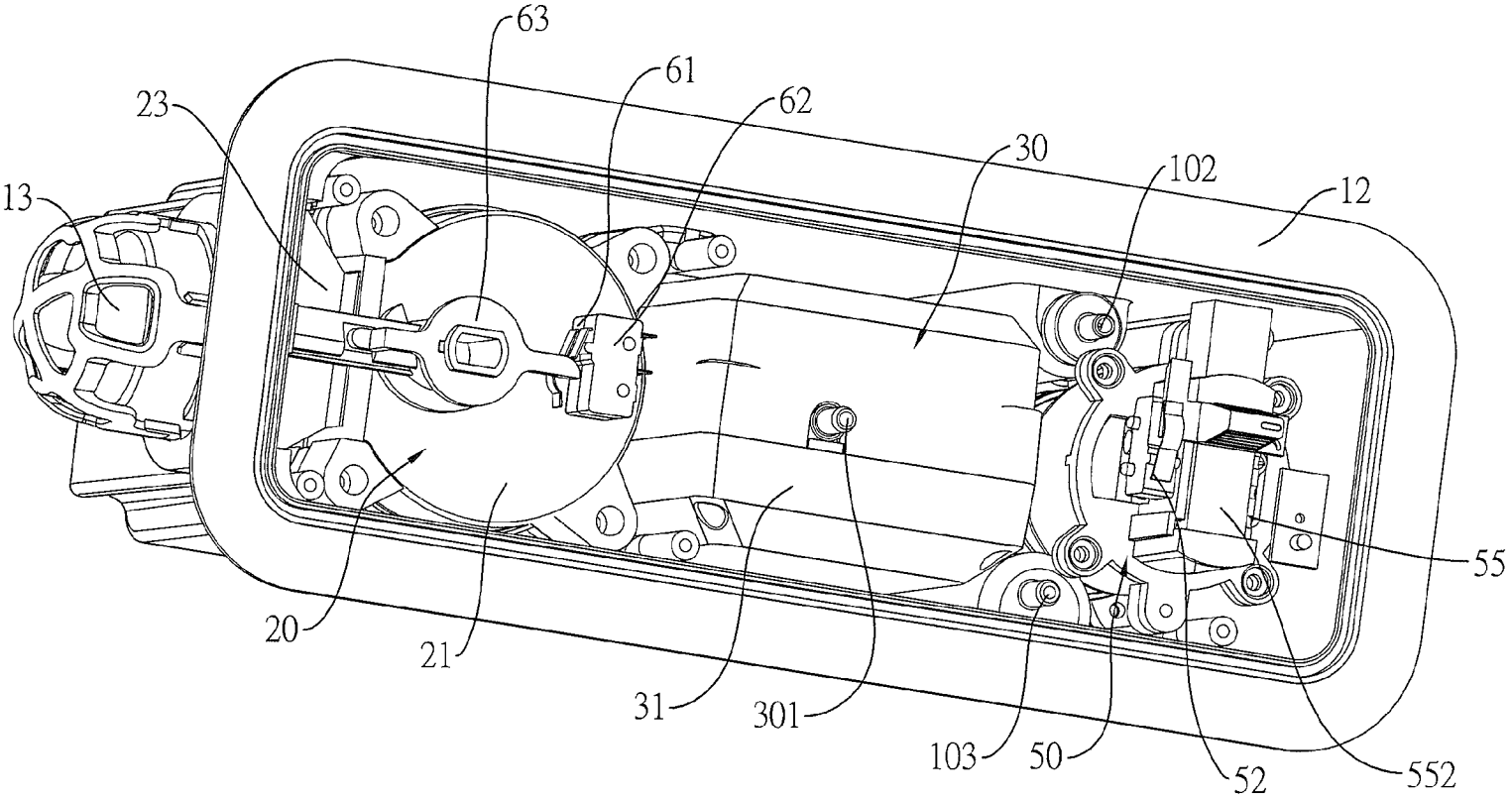
FIG. 4 is an upper perspective view of the air pump in FIG. 1, showing a cover is omitted.

As shown in FIGS. 1 to 3, in the preferred embodiment, the second control mechanism 26 has a bolt 262 and a turning button 261. The bolt 262 is connected to the switching casing 23. The turning button 261 is connected to the bolt 262 and protrudes out of the housing 10. As the turning button 261 is turned, the bolt 262 drives the switching casing 23 to move up and down.

The air pump further comprises a main inflating switch 61, a main deflating switch 62, and a trigger element 63. The main inflating switch 61 and the main deflating switch 62 are disposed beside the second control mechanism 26. The trigger element 63 is mounted on the bolt 262, is driven to move by the bolt 262 of the second control mechanism 26, and has a first triggering arm 631 and a second triggering arm 632. The first triggering arm 631 selectively triggers the main inflating switch 61. The second triggering arm 632 selectively triggers the main deflating switch 62.

Figure 7:
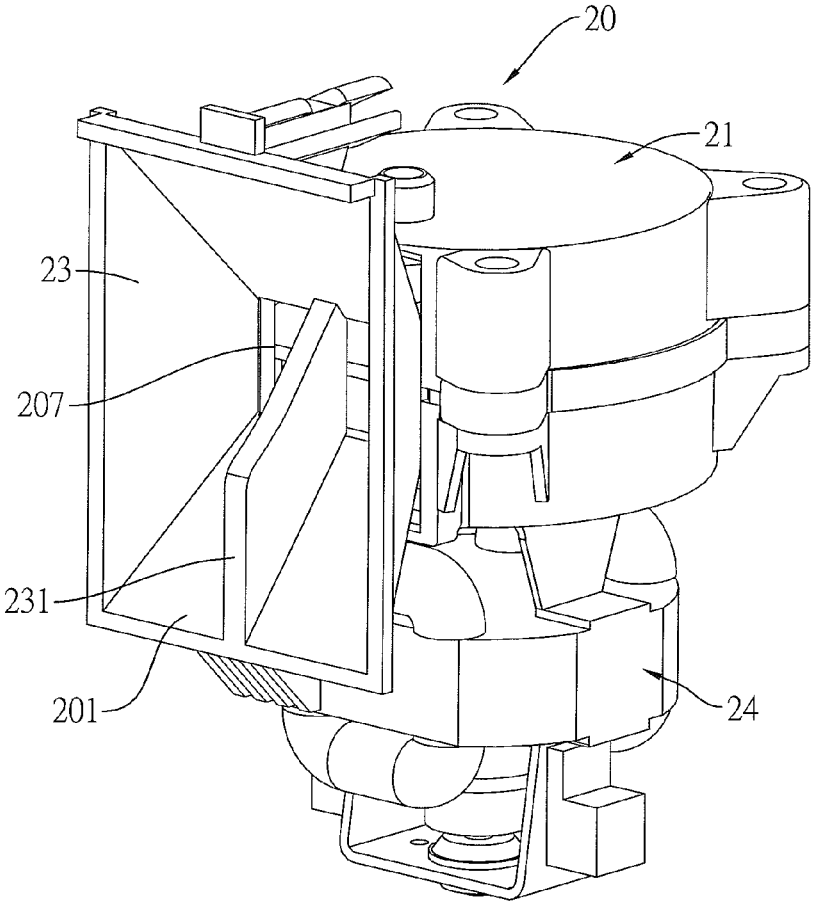
FIG. 7 is a perspective view of a low-pressure blower of the air pump in FIG. 1.
Figure 8:
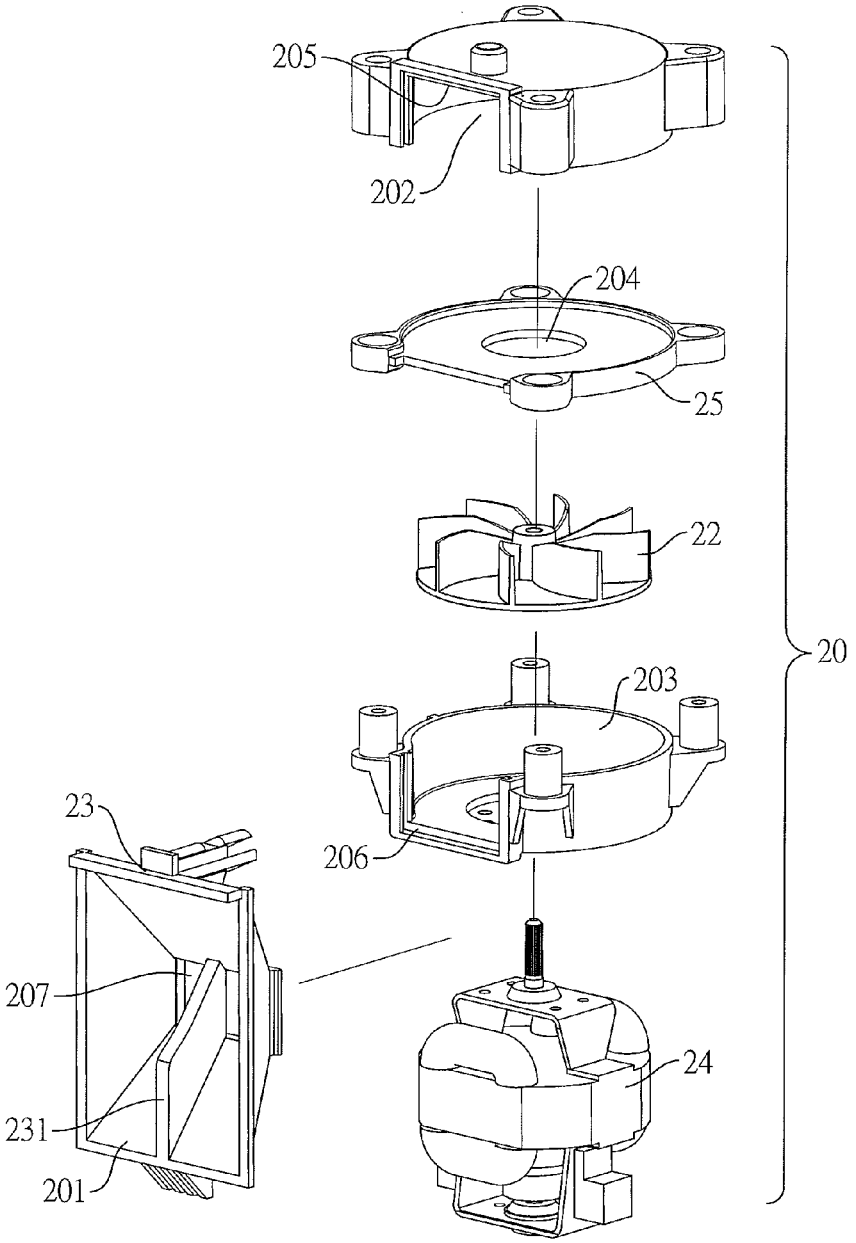
FIG. 8 is an exploded perspective view of the low-pressure blower in FIG. 7.

Moreover, as shown in FIGS. 7 and 8, the switching casing 23 of the low-pressure blower 20 further has a pressing portion 231 selectively opening the first one-way valve 13. When the pressing portion 231 of the switching casing 23 presses against the first one-way valve 13, the first one-way valve 13 is open and the air channel 207 communicates with the inlet port 205 of the third casing 21. When the pressing portion 231 of the switching casing 23 departs from the first one-way valve 13, the one-way valve 13 is closed, and the air channel 207 communicates with the outlet port 206 of the third casing 21.

Figure 13:
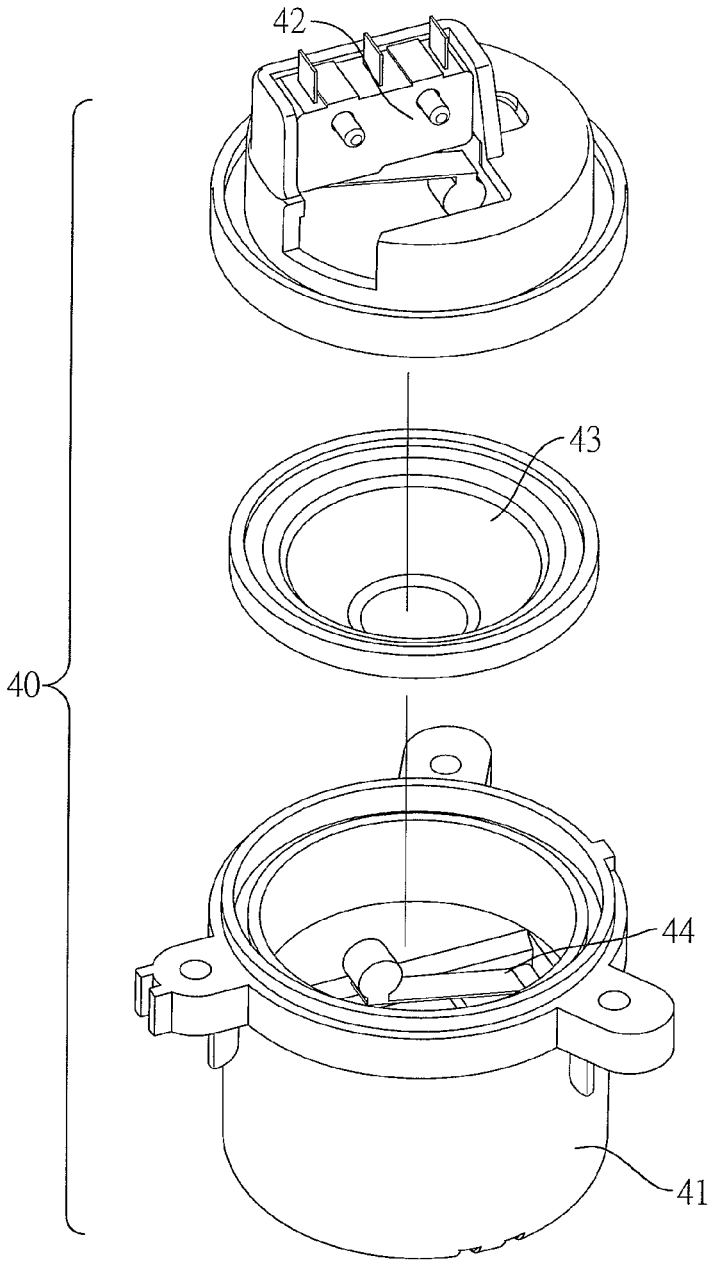
FIG. 13 is an exploded perspective view of the first auto-stop controller in FIG. 12.
Figure 14:
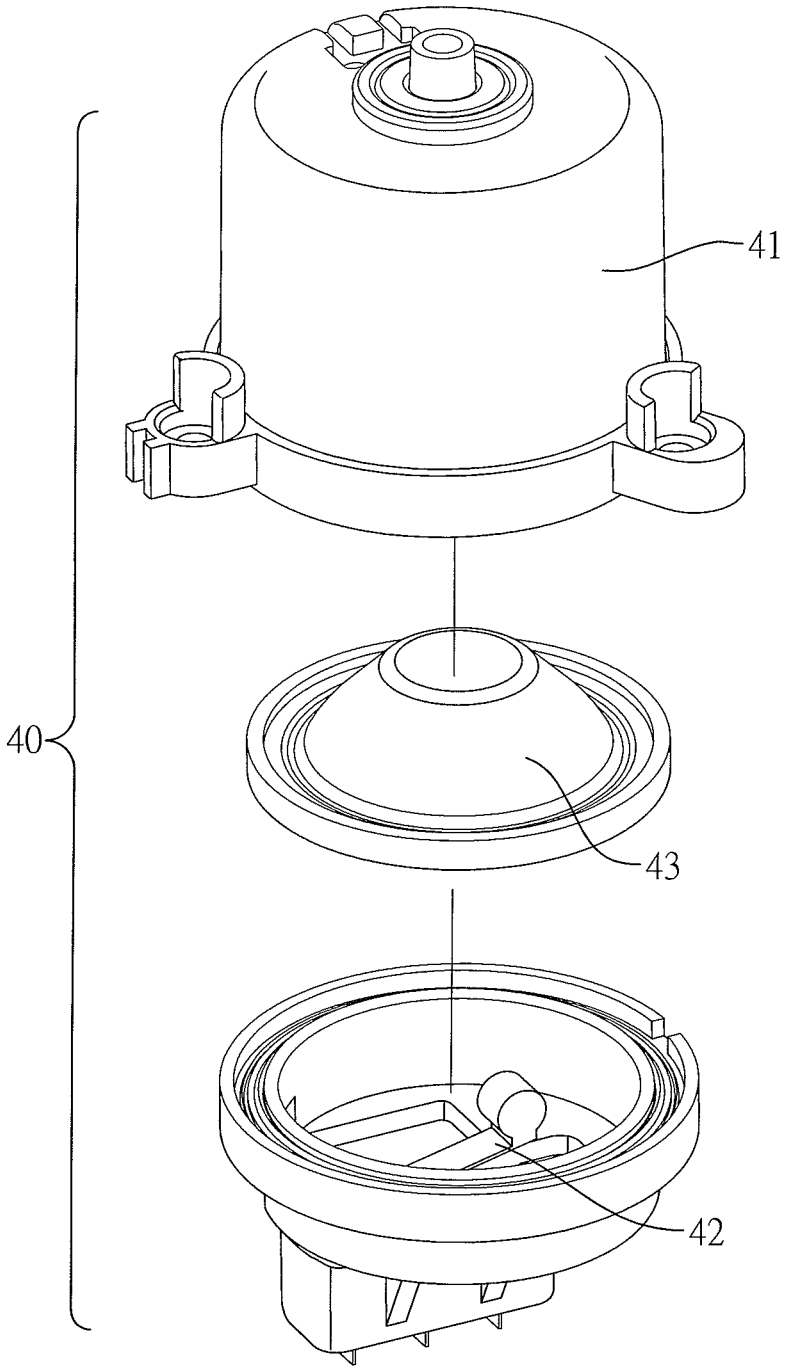
FIG. 14 is another exploded perspective view of the first auto-stop controller in FIG. 12.
Figure 15:
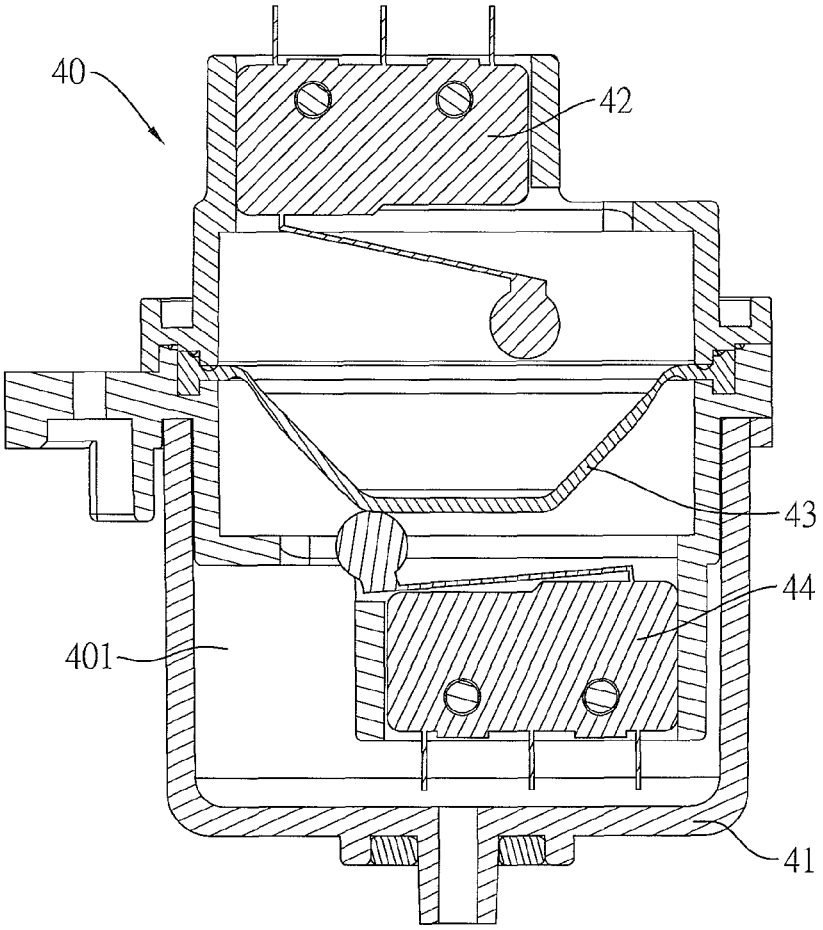
FIG. 15 is a cross-sectional side view of the first auto-stop controller in FIG. 12.
Figure 16:
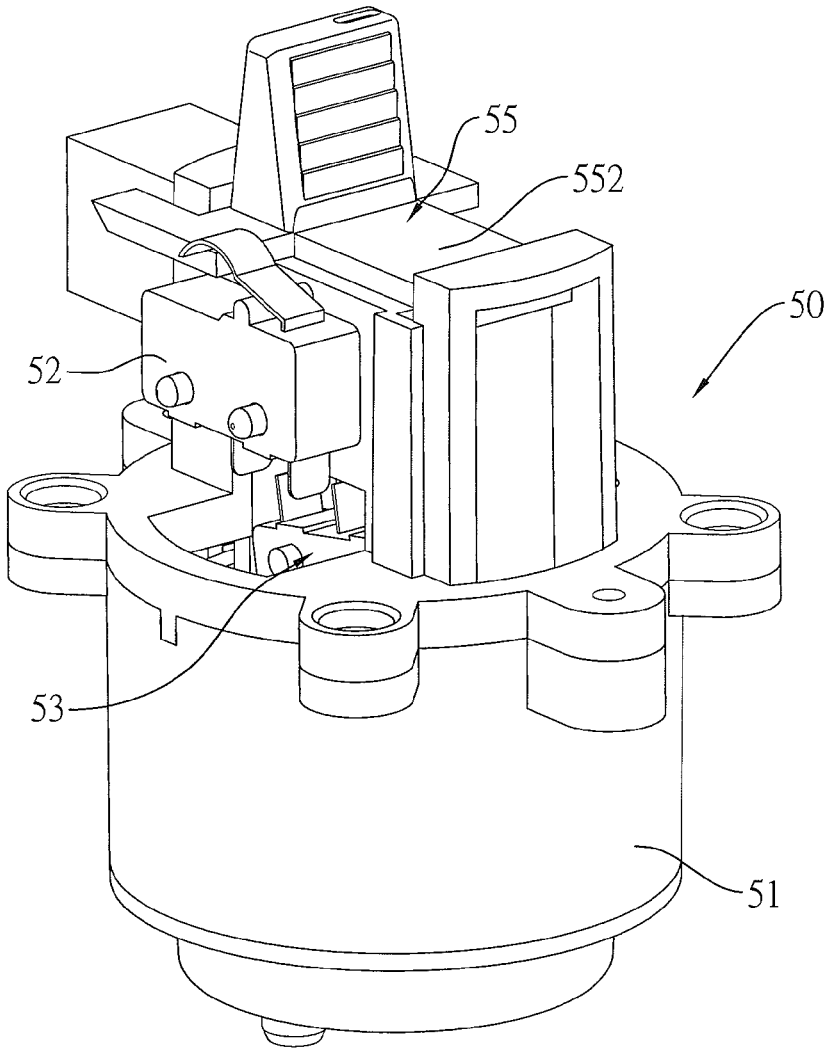
FIG. 16 is a perspective view of a second auto-stop controller of the air pump in FIG. 1.
Figure 17:
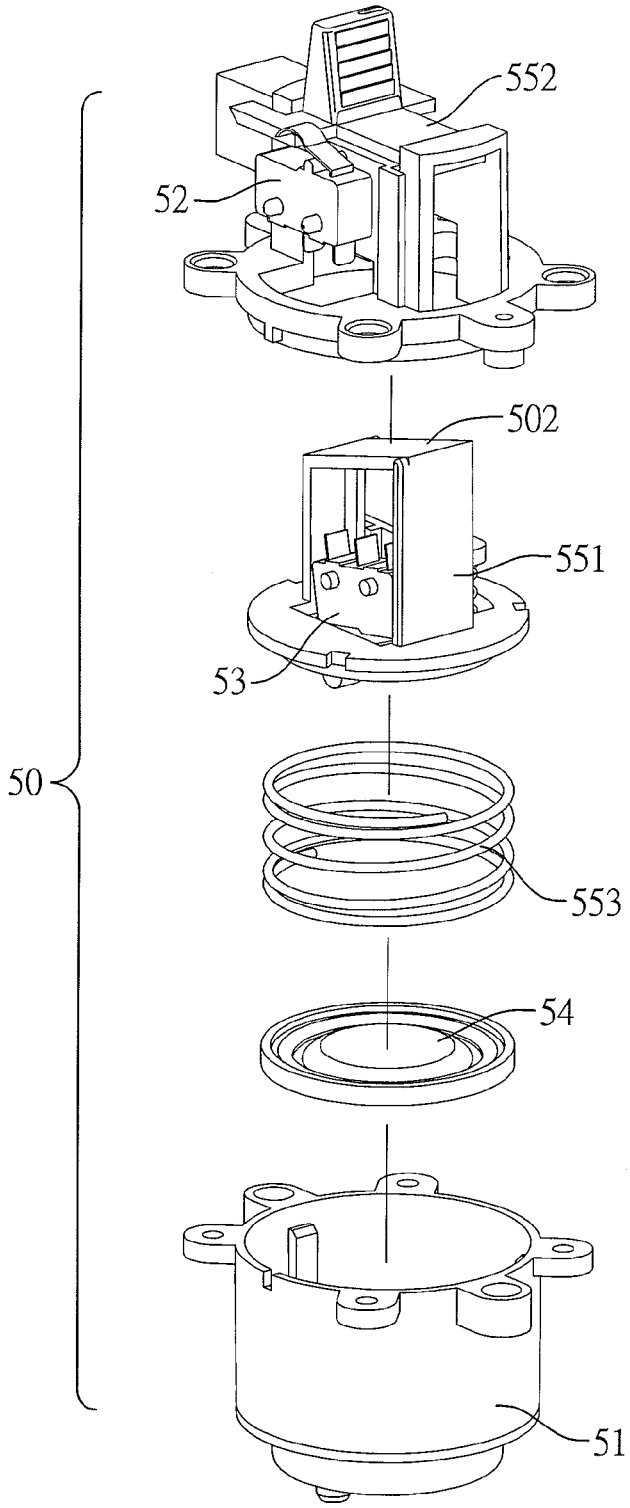
FIG. 17 is an exploded perspective view of the second auto-stop controller in FIG. 16.

Moreover, with reference to FIGS. 13 and 15, the first auto-stop controller 40 further has a third micro switch 44. The third micro switch 44 is mounted in the first enclosed chamber 401 of the first auto-stop controller 40, is electrically connected to the low-pressure blower 20, and switches the low-pressure blower 20 on or off when the air pump deflates the inflatable article. Thus, the air pump can automatically stop operating or supply air to the inflatable article during deflation.

Figure 11:
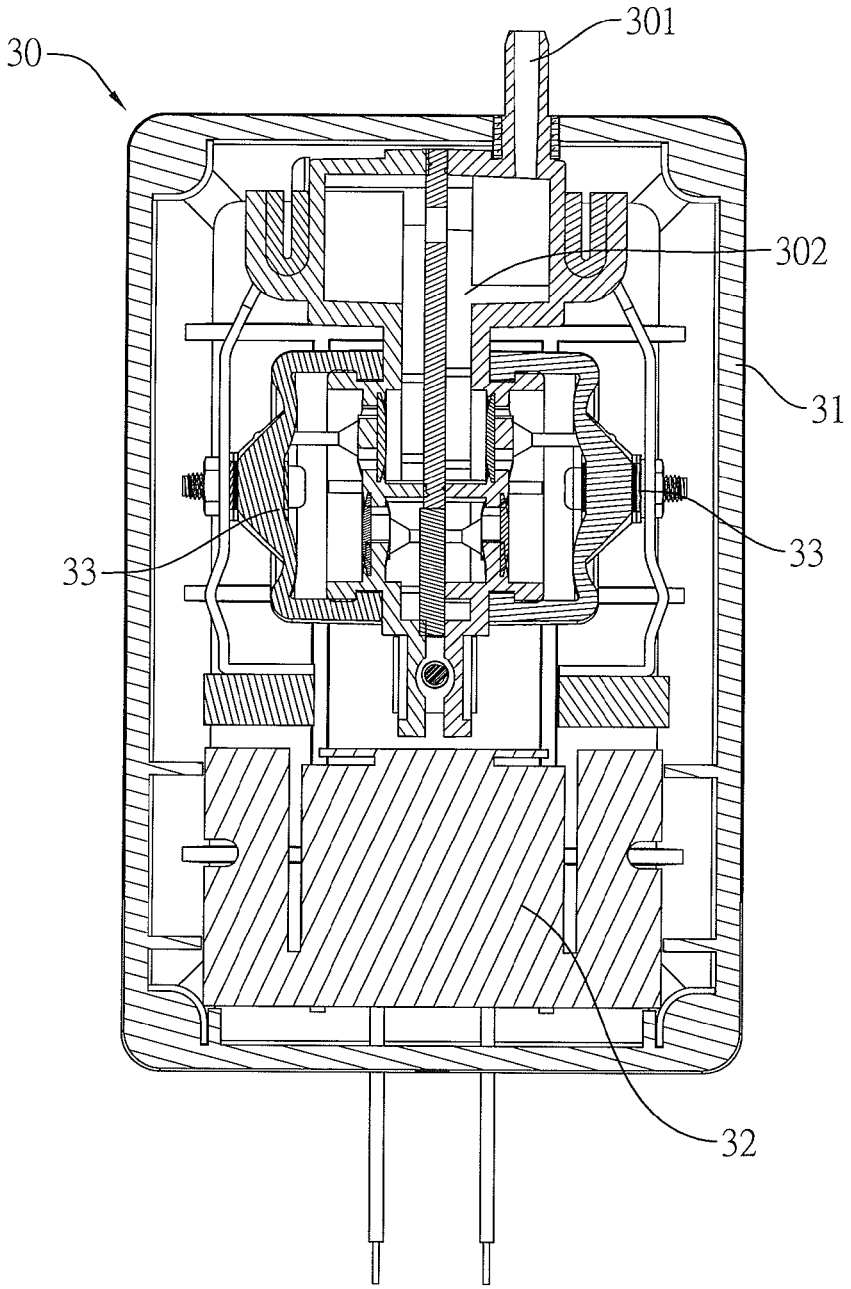
FIG. 11 is a side view in partial section of a high-pressure blower of the air pump in FIG. 1.
Figure 12:
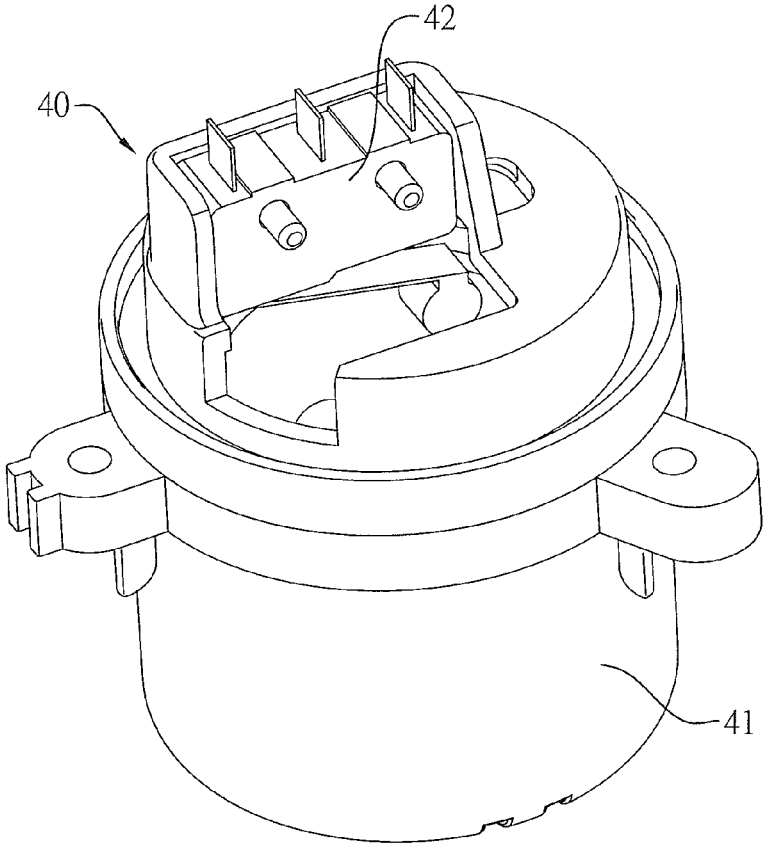
FIG. 12 is a perspective view of a first auto-stop controller of the air pump in FIG. 1.

With reference to FIG. 11, the high-pressure blower 30 further has a fourth casing 31, an electromagnetic assembly 32, and two open-close mechanisms 33. The electromagnetic assembly 32 and the open-close mechanisms 33 are mounted in the fourth casing 31. The open-close mechanisms 33 are connected to the electromagnetic assembly 32 and are driven to open or to close relative to each other by the electromagnetic assembly 32. When the open-close mechanisms 33 are open relative to each other, an air chamber 302 is formed between the open-close mechanisms 33 and communicates with the fifth air port 301 of the high-pressure blower 30.

With reference to FIGS. 16 to 20, the first control mechanism 55 of the second auto-stop controller 50 has a moving element 551, a pushing button 552, and a restoring spring 553. The moving element 551 is movably mounted above the outer surface of the second sensing film 54 and has a first inclined surface 502. The second micro switch 53 is mounted in the moving element 551 and moves along with the moving element 551. The pushing button 552 is mounted on the moving element 551, protrudes out of the housing 10, and has a second inclined surface 503. The second inclined surface 503 of the pushing button 552 abuts the first inclined surface 502 of the moving element 551. When the pushing button 552 is pushed to move, the moving element 551 is forced to move toward or away from the second sensing film 54. Accordingly, a distance defined between the second micro switch 53 and the second sensing film 54 can be adjusted. The switching switch 52 is disposed beside the pushing button 552. The restoring spring 553 is mounted between the moving element 551 and the second casing 51, and has two ends respectively abutting the moving element 551 and the second casing 51. Thus, the moving element 551 is pushed to move upwardly by the restoring spring 553.

Moreover, the second casing 51 of the second auto-stop controller 50 further has multiple clutching portions 504. The clutching portions 504 are arranged along a moving path of the pushing button 552. The pushing button 552 further has multiple engaging protrusions. Each of the engaging protrusions of the pushing button 552 selectively engages with one of the clutching portions 504 of the second casing 51. Thus, the pushing button 552 can be moved in multiple stages. Accordingly, the second auto-stop controller 50 can control the high-pressure blower 30 in multiple stages.

Figure 18:
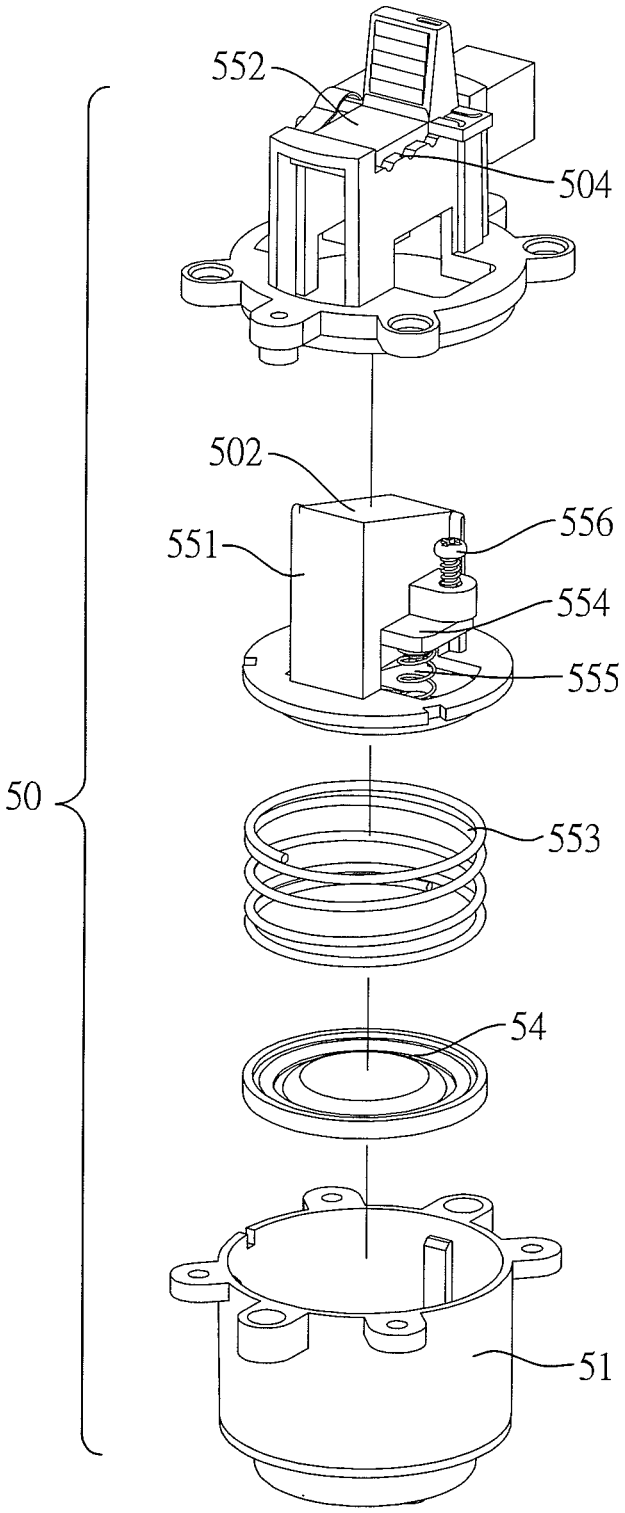
FIG. 18 is another exploded perspective view of the second auto-stop controller in FIG. 16.
Figure 19:
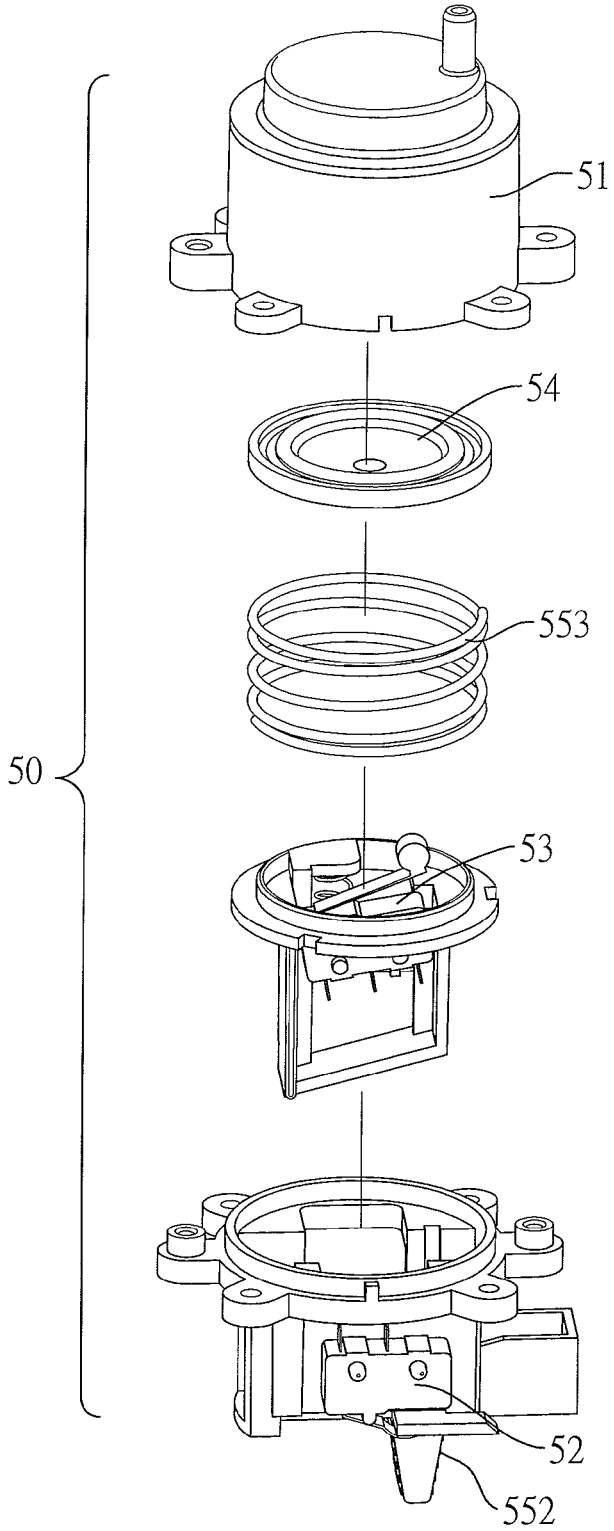
FIG. 19 is still another exploded perspective view of the second auto-stop controller in FIG. 16.
Figure 20:
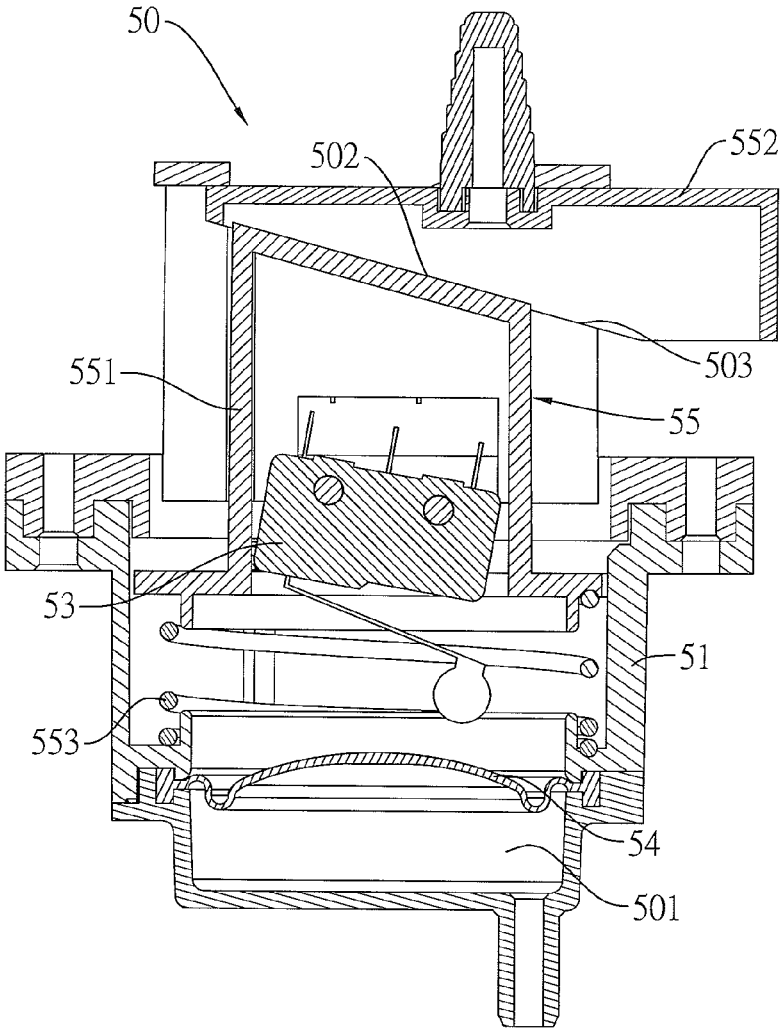
FIG. 20 is a cross-sectional side view of the second auto-stop controller in FIG. 16.

Moreover, as shown in FIG. 18, the first control mechanism 55 further has a moving panel 554, a pressed spring 555, and an adjusting screw 556. The moving panel 554 is movably mounted on the moving element 551 and has a lower surface and an upper surface. The second micro switch 53 is securely mounted on the moving panel 554 and is mounted in the moving element 551 along with the moving panel 554. The pressed spring 555 is mounted between the moving panel 554 and the moving element 551 and has two ends respectively abutting the lower surface of the moving panel 554 and the moving element 551. The adjusting screw 556 is mounted through the moving element 551 and has a lower end abutting the upper surface of the moving panel 554. Thus, when the adjusting screw 556 is turned to move downward, the adjusting screw 556 pushes the moving panel 554 to move downward accordingly. When the adjusting screw 556 is turned to move upward, the pressed spring 555 pushes the moving panel 554 as well as the second micro switch 53 to move upward accordingly.

The air pump capable of automatic air supplements of the present invention works as follows.

For inflation, a position of the second micro switch 53 can be adjusted according to a demand for hardness of the inflatable article. Specifically, the pushing button 552 is pushed to one of the clutching portions 504 of the second casing 51. With the second inclined surface 503 of the pushing button 552 guiding the first inclined surface 502 of the moving element 551, the moving element 551 is moved. Accordingly, the second micro switch 53 moves along with the moving element 551 to a suitable position. As the distance defined between the second micro switch 53 and the second sensing film 54 is longer, the inflatable article is harder after inflating. As the distance defined between the second micro switch 53 and the second sensing film 54 is shorter, the inflatable article is softer after inflating. When the pushing button 552 is moved to a specific position, the switching switch 52 is triggered and is switched on simultaneously.

Then, the turning button 261 is turned to drive the bolt 262 to rotate. As the bolt 262 rotates, the switching casing 23 is driven to move downward to allow the air channel 207 of the switching casing 23 to communicate with the outlet port 206 of the third casing 21 and the fourth air port 201 of the low-pressure blower 20. Thus, the inlet port 205 of the third casing 21 of the low-pressure blower 20 communicates with the exterior of the housing 10.

Meanwhile, the trigger element 63 is rotated along with the bolt 262, such that the first triggering arm 631 of the trigger element 63 presses against the main inflating switch 61. Consequently, the low-pressure blower 20 begins working. The motor 24 drives the impeller 22 to rotate and to suck air outside the housing 10, thereby forming an air current. The air current pushes and opens the first one-way valve 13 and inflates the inflatable article. With an air pressure inside the inflatable article increases, an air pressure inside the first enclosed chamber 401 of the first auto-stop controller 40 increases accordingly, and the first sensing film 43 of the first auto-stop controller 40 deforms upward. When the air pressure inside the inflatable article achieves a pre-set low pressure, the first micro switch 42 is triggered by the first sensing film 43, and the low-pressure blower 20 stops working.

Meanwhile, as the switching switch 52 is triggered and is switched on, the high-pressure blower 30 begins working. The electromagnetic assembly 32 drives the open-close mechanisms 33 to open or to close relative to each other and to compress air into the inflatable article. Thus, the air pressure inside the inflatable article increases continuously, an air pressure inside the second enclosed chamber 501 of the second auto-stop controller 50 increases accordingly, and the second sensing film 54 of the second auto-stop controller 50 deforms upward. When the air pressure inside the inflatable article achieves a pre-set high pressure, the second micro switch 53 is triggered by the second sensing film 54, and the high-pressure blower 30 stops working.

As the inflatable article is deflated slightly, the second sensing film 54 of the second auto-stop controller 50 departs from the second micro switch 53, and the high-pressure blower 30 is switched on automatically to inflate the inflatable article with high pressure air. When the air pressure inside the inflatable article achieves the pre-set high pressure again, the second micro switch 53 is triggered by the second sensing film 54, such that the high-pressure blower 30 stops working. Consequently, the air pressure inside the inflatable article is kept at the pre-set high pressure.

As for deflation, the pushing button 552 is pushed to one of the clutching portions 504 that is disposed at a closed position. Thus, the pushing button 552 departs from the switching switch 52. Then, the turning button 261 is turned to rotate the bolt 262. As the bolt 262 is rotated, the switching casing 23 is driven to move downward to allow the air channel 207 of the switching casing 23 to communicate with the inlet port 205 of the third casing 21 and the fourth air port 201 of the low-pressure blower 20. Thus, the outlet port 206 of the third casing 21 of the low-pressure blower 20 communicates with the exterior of the housing 10.

Meanwhile, the pressing portion 231 of the switching casing 23 presses against the driving rod 131 of the first one-way valve 13 to open the first one-way valve 13. Thus, air inside the inflatable article discharges through the first air port 101 of the housing 10, the fourth air port 201 of the low-pressure blower 20, the air channel 207 of the switching casing 23, the inlet port 205 of the third casing 21, the inlet chamber 202 of the third casing 21, the outlet chamber 203 of the third casing 21, and the outlet port 206 of the third casing 21 in sequence.

Meanwhile, the trigger element 63 is rotated along with the bolt 262, such that the second triggering arm 632 of the trigger element 63 presses against the main deflating switch 62. Consequently, the low-pressure blower 20 begins working. The motor 24 drives the impeller 22 to rotate to suck and to discharge the air inside the inflatable article.

When the air pressure inside the inflatable article decreases, the air pressure inside the first enclosed chamber 401 of the first auto-stop controller 40 decreases accordingly, and the first sensing film 43 of the first auto-stop controller 40 deforms downward. When the air inside the inflatable article is discharged completely, the third micro switch 44 of the first auto-stop controller 40 is triggered by the first sensing film 43, and the low-pressure blower 20 stops working. When there is gas flowing into the inflatable article, the first sensing film 43 departs from the third micro switch 44, and the low-pressure blower 20 begins working automatically to deflate the inflatable article. Once the third micro switch 44 is triggered by the first sensing film 43, the low-pressure blower 20 stops working again, such that the inflatable article is kept at an airless status.

The air pump as described has the main technical features as follows. With the low-pressure blower 20 inflating the inflatable article with low pressure air, and with the first micro switch 42 disposed apart from the first sensing film 43, the low-pressure blower 20 stops working as soon as the air pressure inside the inflatable article achieves the pre-set low pressure to allow the first sensing film 43 to press against the first micro switch 42. The air pump can stop working when inflating with low pressure air automatically.

With the high-pressure blower 30 inflating the inflatable article with high pressure air, and with the second micro switch 53 adjustably disposed apart from the second sensing film 54, the inflatable article can be inflated with the high pressure air in order to have hardness suitable for a user's need. Moreover, as the air pressure inside the inflatable article achieves the pre-set high pressure, the second sensing film 54 presses against the second micro switch 53, such that the air pump can stop working when inflating with high pressure air automatically.

When the air pressure inside the inflatable article decreases, the second sensing film 54 departs from the second micro switch 53 to allow the high-pressure blower 30 to begin working automatically. The air pump can supply air when inflating with high pressure air automatically.

In sum, the air pump can stop working automatically and can supply air automatically without manual work. Furthermore, the air pump can inflate the inflatable article to the hardness suitable for the user's need conveniently. With the switching casing 23 driven by the second control mechanism 26, the air channel 207 of the switching casing 23 selectively communicates with the inlet port 205 or the outlet port 206 of the third casing 21. When the air channel 207 communicates with the inlet port 205, the first one-way valve 13 is open to inflate the inflatable article. Thus, the air pump not only can inflate the inflatable article, but also can deflate the inflatable article rapidly.

Meanwhile, with the third micro switch 44 mounted in the first enclosed chamber 401 of the first auto-stop controller 40, the third micro switch 44 switches the low-pressure blower 20 on or off, such that the air pump can stop working automatically and supply air automatically when deflating.

The air pump as described is convenient for use, and is intelligent with user-friendly and humanized design. Furthermore, the air pump has simplified structure, is convenient for assembling, and can achieve high manufacturing efficiency and low manufacturing cost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air pump capable of automatic air supplements comprising:

a housing having:
- a first air port;
- a second air port;
- a third air port;
- a first one-way valve mounted to the first air port; and
- a second one-way valve mounted to the second air port;

a low-pressure blower mounted in the housing and having
- a fourth air port communicating with the first air port of the housing;

a high-pressure blower mounted in the housing and having:
- a fifth air port communicating with the second air port of the housing;
- a high-pressure blower casing;
- an electromagnetic assembly mounted in the high-pressure blower casing; and
- two open-close mechanisms mounted in the high-pressure blower casing, with the two open-close mechanisms connected to the electromagnetic assembly and driven to open or to close relative to each other by the electromagnetic assembly;

wherein when the two open-close mechanisms are open relative to each other, an air chamber is formed between the two open-close mechanisms and communicates with the fifth air port of the high-pressure blower;

a first auto-stop controller mounted in the housing and having:
- a first casing having an inner surface;
- a first micro switch mounted on the first casing, with the first micro switch electrically connected to the low-pressure blower and switching the low-pressure blower on or off;

a first sensing film mounted in the first casing, with the first sensing film selectively triggering the first micro switch and having:

an inner surface; and an outer surface facing and separated from the first micro switch; and a first enclosed chamber surrounded by the inner surface of the first sensing film and the inner surface of the first casing, and communicating with the third air port of the housing; and a second auto-stop controller mounted in the housing and having:

a second casing having an inner surface;

a switching switch electrically connected to the high-pressure blower and selectively switching the high-pressure blower on or off;

a second micro switch mounted on the second casing, with the second micro switch electrically connected to the high-pressure blower and switching the high-pressure blower on or off;

a second sensing film mounted in the second casing, with the second sensing film selectively triggering the second micro switch and having:

an inner surface; and an outer surface facing and separated from the second micro switch;

a second enclosed chamber surrounded by the inner surface of the second sensing film and the inner surface of the second casing, and communicating with the third air port of the housing; and a first control mechanism selectively triggering the switching switch, and driving the second micro switch to move toward or away from the second sensing film.

2. The air pump as claimed in claim 1, wherein the low-pressure blower further has:

a low-pressure blower casing having an inlet port and an outlet port;

a dividing panel mounted in the low-pressure blower casing and dividing an interior of the low-pressure blower casing into an inlet chamber and an outlet chamber, with the inlet chamber communicating with the inlet port, with the outlet chamber communicating with the outlet port, and with the dividing panel having a through hole;

an impeller mounted in the outlet chamber and having:

an air-inlet portion corresponding in position to the through hole of the dividing panel; and an air-outlet portion corresponding in position to the outlet port of the low-pressure blower casing;

a switching casing mounted between the first air port of the housing and the low-pressure blower casing and having an air channel communicating with the inlet port of the low-pressure blower casing or the outlet port of the low-pressure blower casing;

a motor driving the impeller to rotate; and a second control mechanism selectively driving the switching casing to move.

3. The air pump as claimed in claim 2, wherein the switching casing of the low-pressure blower further has a pressing portion selectively opening the first one-way valve;

wherein when the pressing portion of the switching casing presses against the first one-way valve, the first one-way valve is open and the air channel communicates with the inlet port of the low-pressure blower casing; and when the pressing portion of the switching casing departs from the first one-way valve, the one-way valve is closed and the air channel communicates with the outlet port of the low-pressure blower casing.

4. An air pump capable of automatic air supplements comprising:

a housing having:

a first air port;

a second air port;

a third air port;

a first one-way valve mounted to the first air port; and a second one-way valve mounted to the second air port;

a low-pressure blower mounted in the housing and having:

a fourth air port communicating with the first air port of the housing;

a blower casing having an inlet port and an outlet port;

a dividing panel mounted in the blower casing and dividing an interior of the blower casing into an inlet chamber and an outlet chamber, with the inlet chamber communicating with the inlet port, with the outlet chamber communicating with the outlet port, and with the dividing panel having a through hole;

an impeller mounted in the outlet chamber and having:

an air-inlet portion corresponding in position to the through hole of the dividing panel; and an air-outlet portion corresponding in position to the outlet port of the blower casing;

a switching casing mounted between the first air port of the housing and the blower casing and having an air channel communicating with the inlet port of the blower casing or the outlet port of the blower casing; and a motor driving the impeller to rotate;

a high-pressure blower mounted in the housing and having a fifth air port communicating with the second air port of the housing;

a first auto-stop controller mounted in the housing and having:

a first casing having an inner surface;

a first micro switch mounted on the first casing, with the first micro switch electrically connected to the low-pressure blower and switching the low-pressure blower on or off;

a first sensing film mounted in the first casing, with the first sensing film selectively triggering the first micro switch and having:

an inner surface; and an outer surface facing and separated from the first micro switch; and a first enclosed chamber surrounded by the inner surface of the first sensing film and the inner surface of the first casing, and communicating with the third air port of the housing; and a second auto-stop controller mounted in the housing and having:

a second casing having an inner surface;

a switching switch electrically connected to the high-pressure blower and selectively switching the high-pressure blower on or off;

a second micro switch mounted on the second casing, with the second micro switch electrically connected to the high-pressure blower and switching the high-pressure blower on or off;

a second sensing film mounted in the second casing, with the second sensing film selectively triggering the second micro switch and having:

an inner surface; and an outer surface facing and separated from the second micro switch;

a second enclosed chamber surrounded by the inner surface of the second sensing film and the inner surface of the second casing, and communicating with the third air port of the housing; and a first control mechanism selectively triggering the switching switch, and driving the second micro switch to move toward or away from the second sensing film, wherein the low pressure blower further has a second control mechanism selectively driving the switching casing to move and having:

a bolt connected to the switching casing; and a turning button connected to the bolt and protruding out of the housing;

wherein as the turning button is turned, the bolt drives the switching casing to move.

5. The air pump as claimed in claim 4 further comprising:

a main inflating switch disposed beside the second control mechanism;

a main deflating switch disposed beside the second control mechanism; and a trigger element mounted on the bolt of the second control mechanism, with the trigger element driven to move by the bolt of the second control mechanism and having:

a first triggering arm selectively triggering the main inflating switch; and a second triggering arm selectively triggering the main deflating switch.

6. The air pump as claimed in claim 2, wherein the first auto-stop controller further has a third micro switch mounted in the first enclosed chamber of the first auto-stop controller, with the third micro switch electrically connected to the low-pressure blower and switching the low-pressure blower on or off.

7. An air pump capable of automatic air supplements comprising:

a housing having:

a first air port;

a second air port;

a third air port;

a first one-way valve mounted to the first air port; and a second one-way valve mounted to the second air port;

a low-pressure blower mounted in the housing and having a fourth air port communicating with the first air port of the housing;

a high-pressure blower mounted in the housing and having a fifth air port communicating with the second air port of the housing;

a first auto-stop controller mounted in the housing and having:

a first casing having an inner surface;

a first micro switch mounted on the first casing, with the first micro switch electrically connected to the low-pressure blower and switching the low-pressure blower on or off;

a first sensing film mounted in the first casing, with the first sensing film selectively triggering the first micro switch and having:

an inner surface; and an outer surface facing and separated from the first micro switch; and a first enclosed chamber surrounded by the inner surface of the first sensing film and the inner surface of the first casing, and communicating with the third air port of the housing; and a second auto-stop controller mounted in the housing and having:

a second casing having an inner surface;

a switching switch electrically connected to the high-pressure blower and selectively switching the high-pressure blower on or off;

a second micro switch mounted on the second casing, with the second micro switch electrically connected to the high-pressure blower and switching the high-pressure blower on or off;

a second sensing film mounted in the second casing, with the second sensing film selectively triggering the second micro switch and having:

an inner surface; and an outer surface facing and separated from the second micro switch;

a second enclosed chamber surrounded by the inner surface of the second sensing film and the inner surface of the second casing, and communicating with the third air port of the housing; and a first control mechanism selectively triggering the switching switch, and driving the second micro switch to move toward or away from the second sensing film, wherein:

the first control mechanism of the second auto-stop controller has:

a moving element movably mounted above the outer surface of the second sensing film and having a first inclined surface;

a pushing button mounted on the moving element, with the pushing button protruding out of the housing and having a second inclined surface abutting the first inclined surface of the moving element; and a restoring spring mounted between the moving element and the second casing, and having two ends respectively abutting the moving element and the second casing;

the second micro switch of the second auto-stop controller is mounted in the moving element and moves along with the moving element;

the switching switch is disposed beside the pushing button; and when the pushing button is pushed to move, the moving element is forced to move toward or away from the second sensing film.

8. The air pump as claimed in claim 7, wherein:

the second casing of the second auto-stop controller further has multiple clutching portions arranged along a moving path of the pushing button;

the pushing button further has multiple engaging protrusions; and each of the multiple engaging protrusions of the pushing button selectively engages with one of the multiple clutching portions of the second casing.

9. The air pump as claimed in claim 7, wherein:

the first control mechanism of the second auto-stop controller further has:

a moving panel movably mounted on the moving element and having a lower surface and an upper surface;

a pressed spring mounted between the moving panel and the moving element and having two ends respectively abutting the lower surface of the moving panel and the moving element; and an adjusting screw mounted through the moving element and having a lower end abutting the upper surface of the moving panel; and the second micro switch is securely mounted on the moving panel and is mounted in the moving element along with the moving panel.

* * * * *